US009182137B1

(12) United States Patent
Gardella

(10) Patent No.: US 9,182,137 B1
(45) Date of Patent: Nov. 10, 2015

(54) LOW PROFILE, HIGH VOLUME, FILTERED WINDOW FAN

(76) Inventor: George C. Gardella, Ghent, NY (US)

( * ) Notice: Subject to any disclaimer, the term of this patent is extended or adjusted under 35 U.S.C. 154(b) by 882 days.

(21) Appl. No.: 13/445,166

(22) Filed: Apr. 12, 2012

(51) Int. Cl.

| | |
|---|---|
| ***F24F 7/013*** | (2006.01) |
| ***E06B 7/03*** | (2006.01) |
| ***F25D 23/12*** | (2006.01) |
| ***F24F 3/16*** | (2006.01) |
| ***F24F 12/00*** | (2006.01) |
| ***F24F 7/00*** | (2006.01) |
| *F24F 13/075* | (2006.01) |
| *F24F 13/28* | (2006.01) |

(52) U.S. Cl.
CPC . *F24F 7/013* (2013.01); *E06B 7/03* (2013.01); *F24F 3/1603* (2013.01); *F24F 7/00* (2013.01); *F24F 12/006* (2013.01); *F24F 13/075* (2013.01); *F24F 13/28* (2013.01); *F24F 2007/002* (2013.01)

(58) Field of Classification Search
USPC ..... 454/202, 208, 213–215, 225, 155
IPC ..... F24F 7/013,7/03, 3/1603, 12/006, 7/00, F24F 2007/002, 13/075, 13/28; E06B 7/03
See application file for complete search history.

(56) References Cited

U.S. PATENT DOCUMENTS

| | | | | |
|---|---|---|---|---|
| 2,010,808 | A * | 8/1935 | Braine | 454/205 |
| 2,081,105 | A * | 5/1937 | Reynolds et al. | 454/200 |
| 2,373,497 | A * | 4/1945 | Paiste, Jr. | 417/315 |
| 3,416,329 | A * | 12/1968 | Marshall | 62/262 |
| 4,865,118 | A * | 9/1989 | Moland | 165/229 |
| 5,197,299 | A * | 3/1993 | Sohn et al. | 62/262 |
| 5,660,605 | A | 8/1997 | Chan et al. | |
| 5,730,651 | A | 3/1998 | Chen et al. | |
| 6,818,035 | B2 | 11/2004 | McGahey, Jr. | |
| 2004/0118093 | A1 * | 6/2004 | Chang et al. | 55/471 |

OTHER PUBLICATIONS

Unk, Window Fan with Remote Control, Internet page, Apr. 8, 2012, Bionaire, http://www.bionaire.com/Product.aspx?cid=47&pid=209, model BW2100R-U.

Unk, Bionaire EverFresh(TM) Air Exhange System, Instruction Leaflet, Internet page, Apr. 8, 2012, Bionaire, http://www.bionaire.com/Product. (See About the Filters and Performing Maintenance).

* cited by examiner

*Primary Examiner* — Steven B McAllister
*Assistant Examiner* — Helena Kosanovic
(74) *Attorney, Agent, or Firm* — Stan Collier, Esq.

(57) ABSTRACT

A low profile, high volume window fan has a large air filter mounted horizontally therein. The fan is enclosed in a rectangular box-like frame having a sloped top cover. The front section includes a squirrel cage blower, a front louvered section for directing the flow of air into the room, and a horizontally opening door for controlling the flow of air through the fan from either the outside air or the inside air, and for the insertion of the filter therein. The bottom surface includes an external opening for outside air. A double plenum is provided within the frame with the filter dividing the two plenums. When the door is closed, outside air is forced to flow into the second plenum, being in the bottom of the frame and under the filter and through the filter. When the door is opened, interior air is then filtered and circulated.

13 Claims, 7 Drawing Sheets

LOW PROFILE, HIGH VOLUME, FILTERED WINDOW FAN

CROSS-REFERENCES TO RELATED APPLICATIONS

NA

REFERENCE TO FEDERALLY SPONSORED RESEARCH OR DEVELOPMENT

NA

REFERENCE TO JOINT RESEARCH AGREEMENTS

NA

REFERENCE TO SEQUENCE LISTING

NA

BACKGROUND OF THE INVENTION

1. Field of the Invention

The present invention relates generally to window fans, and, more particularly, to window fans with filters, and in greater particularly, to low profile and high volume window fans with filters.

2. Description of the Prior Art

Not having a good night sleep is probably one of the single most important factors leading to problems the next day. Many of the factors that affect our sleep are not within our control such as external events that still raise our level of anxiety, but even some things that we think that we have control over can still cause great anxiety such as family issues, money issues, work issues, health issues, etc.

Nothing is more stressful to a person trying to sleep than allergies to air borne agents such as pollen, animal dander, etc. These can cause sniffling, running eyes, coughing, etc. A person who suffers from pollen allergy greatly desires air purification in almost all locations in a home, but especially in the bedroom. Having a sleepless night caused by pollen allergy in the spring is very harmful and upsetting and thus having both purified air and fresh air would greatly aid sleep.

Obviously having a whole house air conditioning system with built in filters would offer the best solution, but this is expensive and many homes can not be retrofitted even if it was affordable. A prior solution to this issue is the use of window fans having some form of filters.

This problem is addressed by some of the products on the market. One attempted solution is the use of a filter mounted in the window where the house has a whole house exhaust fan. One such product is sold by Bionaire® as a window mounted air exchange system called EverFresh®. This unit is mounted in the lower open window area and has several unique and changeable filters therein. But this unit blocks the lower half of the window. This unit is thus not low profile, and it is not high volume since the size of the filters are limited to an open area smaller than the bottom half of an open window.

Several patents were found directed at window fans, but these are vertically mounted and substantially block the lower window in a double hung window. Even with the attachment of filters thereon, by hook or crook, a substantial frame would be required to prevent water entrance into the filter area and hold the filter separate from the window fan. See for example, U.S. Pat. No. 6,818,035 that has unique filters mounted within the plenums.

A low profile window fan is shown in U.S. Pat. No. 5,730,651, but it lacks any filters or even the ability to place such thereon. Its construction allows it to both input air and exhaust air at the same time by the use of two squirrel cage blowers operating in different directions.

U.S. Pat. No. 5,660,605 is similar to the above patent, but it does include a pair of filters mounted vertically in slots on the top inside of the fan frame. This patent employs a unique air deflector 36 that is not required in the present invention. Further the size of the filters are limited by the height of the fan and the width. They are vertically mounted as compared to the horizontal mounting of the large filter in the present invention. The above products and patents are incorporated by reference Accordingly, there is a need for a low profile, high volume window fan having a large filter thereon.

SUMMARY OF THE INVENTION

The present invention is directed at a low profile, high volume window fan having a means for not only controlling the flow of air from the outside and inside, but also having filter means easily mounted therein without the need for opening the window or removing the unit from the window.

The present invention provides a low profile, high volume window fan having a large air filter therein. The fan is enclosed in a rectangular box-like frame having a sloped top cover with a height less than 9 inches. The frame being approximately sized as about 20 inches across the front and about 30 inches in depth. The frame is mounted in the bottom area of a double-hung window such as with an air conditioner. Side wings would be attached to block the area from the frame to the vertical sides of the window frame. The front section, being within the room, of the frame includes a squirrel cage blower with appropriate controls and wiring, and a front louvered section for directing the flow of air into the room although this embodiment may eliminate these louvers and replace with a screen to prevent accidental contact with the blower fan, and a horizontally opening door for controlling the flow of air through the fan from either the outside air or the inside air, and for the insertion of the filter therein.

The center section of the frame, being both on the outside and inside of the window, has a large purification filter mounted therein. The bottom outer surface of the frame includes an external opening for outside air. A screen is mounted over the external opening to prevent bugs from entering therein. A double plenum is provided within the frame from bottom to top having the filter dividing the two plenums. The interior, or room side of the lower plenum has a hinged door which is connected to a louvered or sliding slat closing arrangement over the external opening for the outside air by means of a push rod or otherwise. When the interior door is closed, only outside/external air is allowed into the lower plenum, through the filter then into the upper plenum to the blower, then out into the room. When the interior door is open, the exterior louvers or slats are closed allowing only interior air to enter into the lower plenum, through the filter then into the upper plenum to the blower, then out into the room. A varying combination of both outside air and inside air could also be selected by intermediate movement of the door.

This low profile, high volume, air purification device also places positive air pressure in the room to maintain fresh purified interior air. Thus, any other openings such doors or other windows would have the air flowing out from this room.

As another embodiment, a low profile, high air flow, filtered window fan may just purify only outside air rather than both inside and outside air. In this regard, the lower plenum and the door and the linking means between the pivoting door and the louvers/slats on the outside air intake can be eliminated considerably lowering the cost of production. The front section may include a closable door where the filter may be inserted or the filter may be placed in the bottom section but this would require either the fan to be removed from the window or reaching up to remove the filter from the outside which may require the use of a ladder.

An object of the present invention is to provide a low profile, high volume air flow window fan with a large air purification filter therein.

It is another object of the present invention to provide the low profile, high volume air flow window fan with a large air purification filter therein which can be easily changed without removing the fan or opening the window.

It is a further object of the present invention to provide the low profile, high volume air flow window fan with a large air purification filter horizontally mounted therein which can be easily changed without removing the fan or opening the window.

It is still a further object of the present invention to provide the low profile, high volume air flow window fan with a large air purification filter therein which can output outside air or circulate interior air or a combination there between.

It is yet a further object of the present invention to provide the low profile, high volume air flow window fan with a large air purification filter therein that is able to place a positive air pressure in the room.

It is yet a further object of the present invention to provide the low profile, high volume air flow window fan with a large air purification filter therein that is able to only purify outside air.

It is yet a further object of the present invention to provide a device that could both filter fresh air going into a room or structure while providing a positive pressure inside that room, or in a reverse mode, filtering out old or contaminated air from a room or structure with a reverse flow and also creating a negative pressure by simply reversing the device and installing appropriate filters therein.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION OF THE PREFERRED EMBODIMENTS

The present invention is directed at a low profile, high air volume window fan having a means for not only controlling the flow of air from the outside and inside, but also having filter means easily mounted therein without the need for opening the window or removing the unit from the window. A further embodiment only allows outside air to be filtered.

Figure 1A:
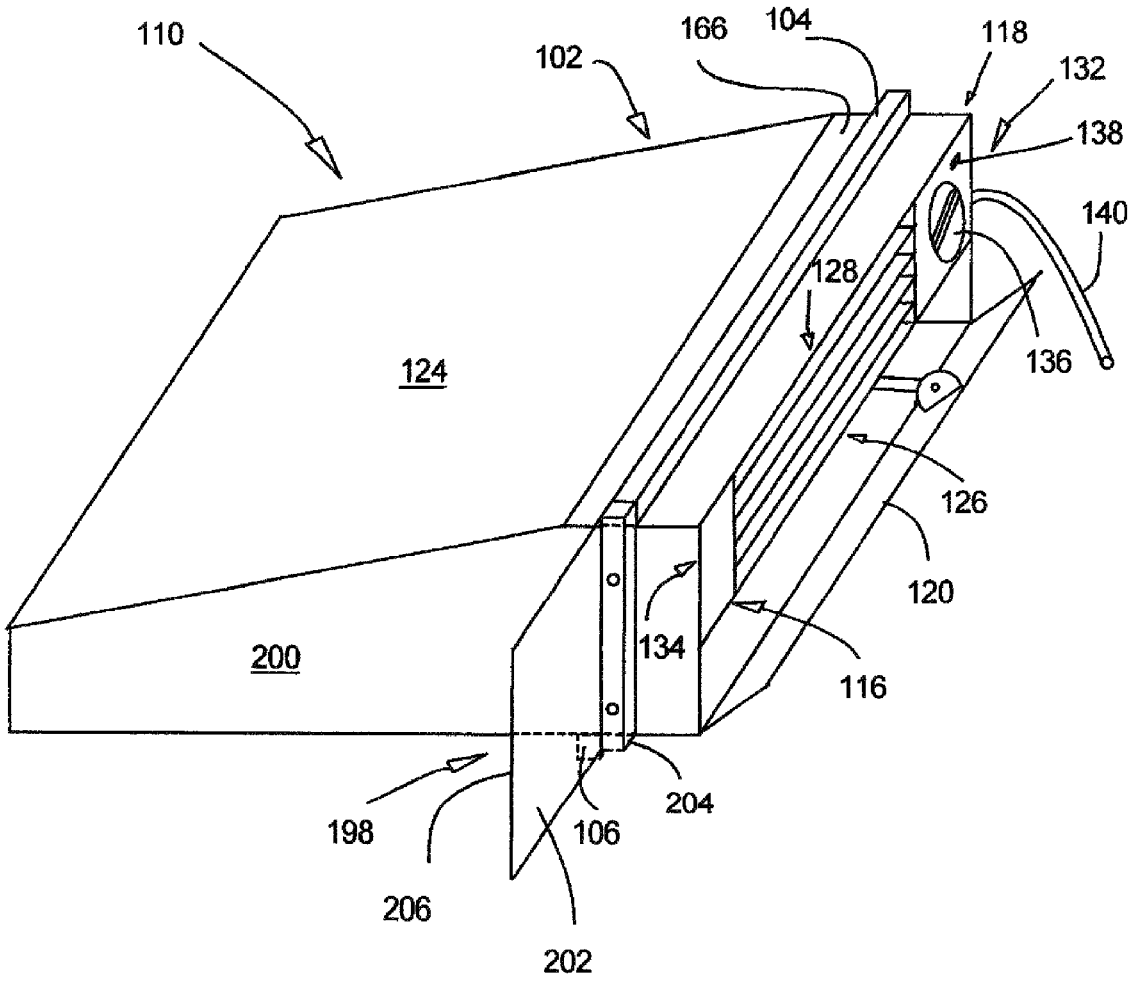
FIG. 1A is a perspective view of a window fan of the present invention.

Turning to the drawings, wherein like components are designated by like reference numerals throughout the various figures, attention is initially directed to FIG. 1A which illustrates one embodiment by perspective view of a low profile, high air volume, filtered window fan 100 constructed according to the present invention.

The low profile, high volume, filtered window fan 100 has a box-like frame 102 that is adapted to mount in a lower section of a double hung window being of conventional design in a low profile configuration. The fan 100 is secured in the window frame by an upper window stop 104 resting against a horizontal sash of the window, and a lower window stop 106 shown in outline resting against a sill of the window. The mounting is similar to that of an air conditioner.

The low profile, high volume, filtered window fan with the box-like frame 102 has a top cover 124 that slopes downwardly from the window to allow water to drain away from the window. The box-like frame 102 is approximately 20 inches wide, approximately 30 inches deep and 8 inches high in the front section 118, a back section 146 being about 5 inches high, and a flat upper section 166 being about 6 inches deep. The box-like frame can be made of plastic, metal or a combination of these as is well known to one skilled in the art.

Figure 1B:
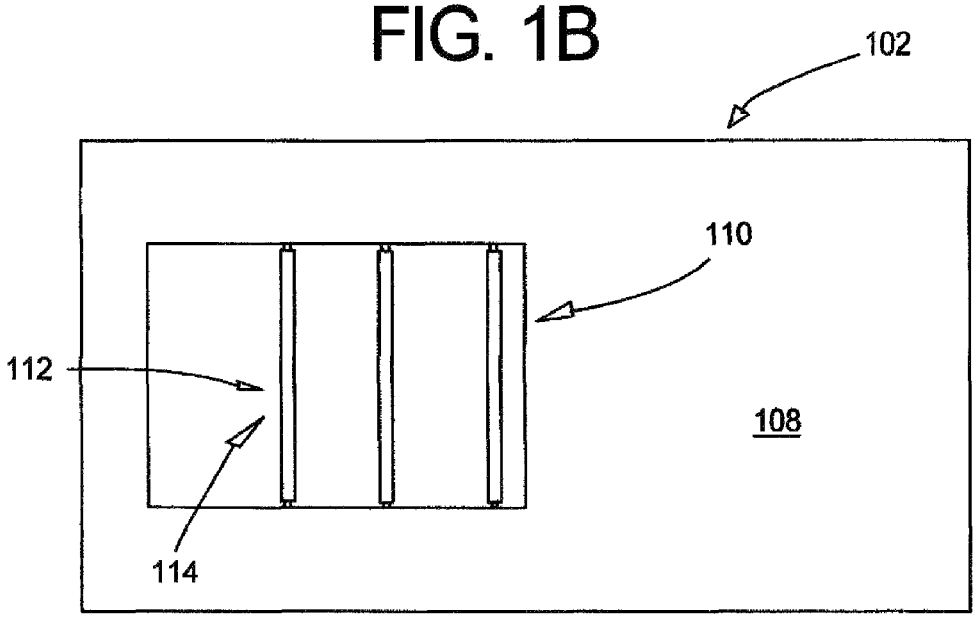
FIG. 1B is a bottom view illustration of the window fan of the present invention as shown in FIG. 1A showing the exterior air intake and a means to control the air flow therethrough of the present invention.
Figure 2:
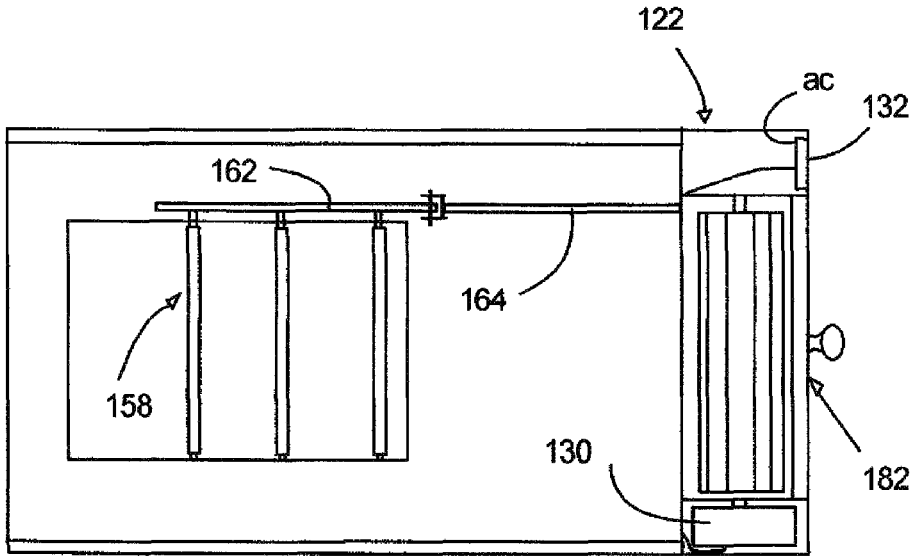
FIG. 2 is a top view illustration of the window fan with a top cover removed showing some features therein of the present invention.

As seen in FIG. 1B, a bottom section 108, or bottom outside surface, has an outside air intake 110 that is positioned on an outside of the window when the fan 100 is mounted therein. A means for controlling the air flow 112 through the outside air intake 110 is shown as a plurality of louvers 114 as to be further explained herein. An inside air intake 116 is shown in FIG. 1A as being mounted in a front section 118 of the box-like frame 102 and is located inside of the house when the fan 100 is mounted therein. The inside air intake 116 has a hinged door 120, but other designs are clearly possible such as one or more sliding doors or rotatable louvers. A blower fan 122 is shown mounted near a front section 108 of the box-like frame 102 in FIG. 2 where a top cover 124 has been removed for purposes of discussion. An air exhaust section 126 is shown between the blower fan 122 and the room. The air exhaust section 126 may have a plurality of hinged louvers 128, but this may not be necessary since the air is not air-conditioned. The louvers 128 can be independently hinged or ganged together. Although louvers 128 are shown, a protective safe guard screen may also be placed therein to prevent accidental contact with the blower fan.

The blower fan 122 has an electric motor 130 being operated from a control section 132 mounted in the upper front section 134. The control section 132 has a speed control 136 and an on-off switch 138 therein for supplying power to the blower fan motor 130 from an external power source input by an AC cord 140. The motor 120 turns a squirrel cage blower fan 182 and mounted in a horizontal position. The speed control 136 and on-off switch 138 may be combined into a single unit that has an off position and when turned or rotated therefrom operates as a speed control.

Figure 3A:
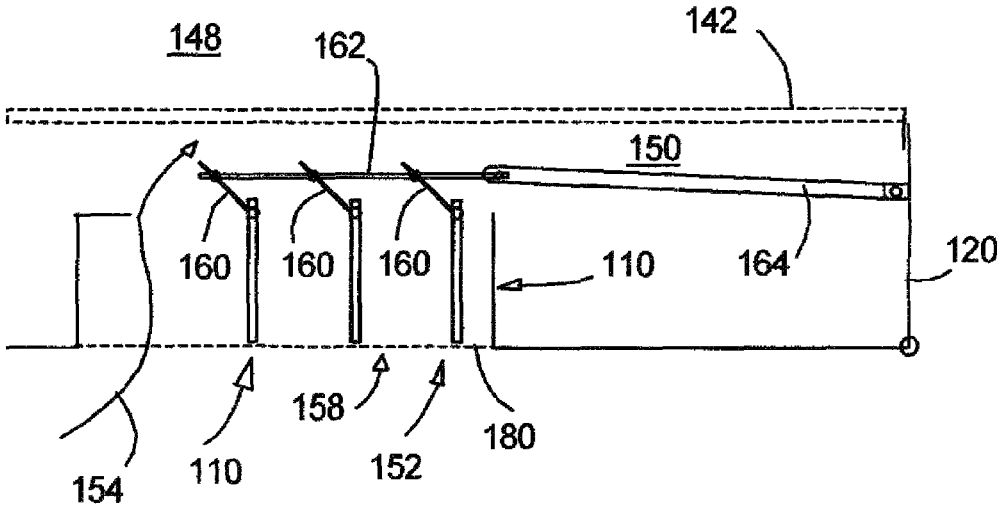
FIGS. 3A and 3B illustrate the means of controlling air flow through the window fan as shown in FIG. 1 of the present invention.
Figure 3B:
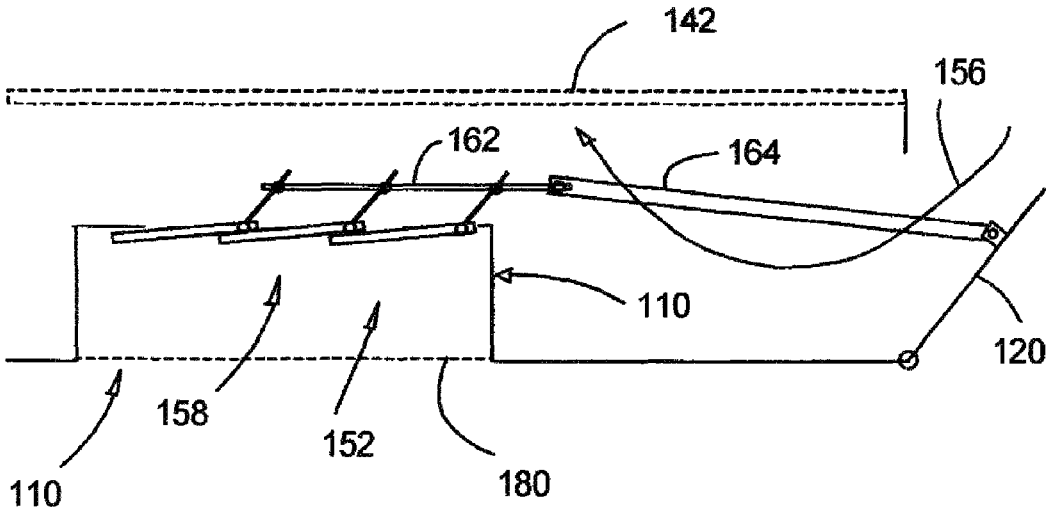
Figure 4:
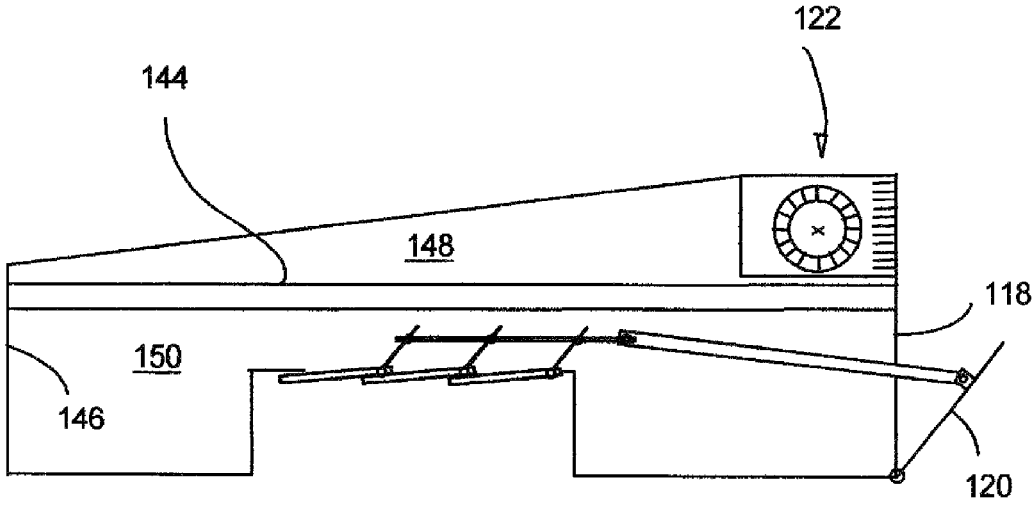
FIG. 4 is a cross sectional vertical view through the window fan of FIG. 1 of the present invention.

A means for mounting a filter 142 is shown in outline in FIGS. 3A and 3B in said box-like frame 102. FIG. 4 shows one of two L shaped rails 144 mounted between a back wall section 146 and the front section 118. To access this area for insertion of the filter 142, the door 120 is opened to sufficiently allow the filter 142 to be inserted on to the rails 144. The insertion of this large filter 142 is accomplished without removing the fan 100 or going outside. The main type of filter being those that are used in central air conditioning systems. Manufacturers are American Air Filter, Energy Aire, Flander E-Z Green being of a size of 20 inches by 25 inches by 1 inch; and 3M 1550 Allergen and 3M Filtrete 1250 microparticule performance rating and Filtrete Ultra Allergen Air Filter, 1250 Purple, claims to remove pollen, dust mites, smoke, dander, dust, smog, and particles carrying bacteria. In the preferred embodiment, a 20 by 25 by 1 inch filter is used.

When the filter 142 is insert therein as shown in FIG. 3, an upper plenum 148 and a lower plenum 150 are created within the box-like frame 102. The upper plenum 148 provides outside air to the blower fan 122 and the lower plenum 150 provides inside air to the blower fan 122 but which must further travel through the upper plenum 148 through the filter 142 as will be further described. There are many types of filters available.

A means for controlling 152 an amount of outside air and inside air to the blower fan 122 is shown in FIG. 3A, only outside air 154, and FIG. 3B, only inside air 156. As seen therein, the means for controlling 152 the air flow in the outside air intake 110 shows a set of three louvers 158 each having a lever rod 160 that are ganged together by a first control rod 162. The first control rod is then operatively connected to a second control rod 164 that is pivotally connected to the door 120. Clearly other means for connecting louvers 158 and the door 120 are possible. As seen in FIG. 3A, the air intake is open and the outside air 154 flows into the lower plenum 150 to the filter 142 and into the second plenum 148 to the blower fan 122. To purify interior air, the door 120 is opened as shown in FIG. 3B to cause the second rod 164 to pull the first rod 162 that then rotates the louvers to the closed position as shown in FIG. 3B. The inside air 156 flows into the lower plenum 150 and then through the filter 142 into the upper plenum 148 to the blower fan 122. FIG. 4.

Figure 5A:
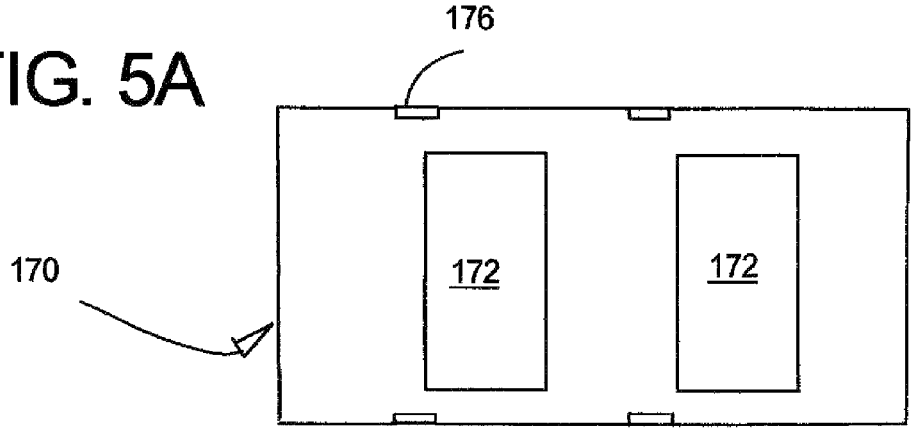
FIGS. 5A to 5C illustrate a different embodiment of a means to control the air flow through the window fan of the present invention.
Figure 5B:
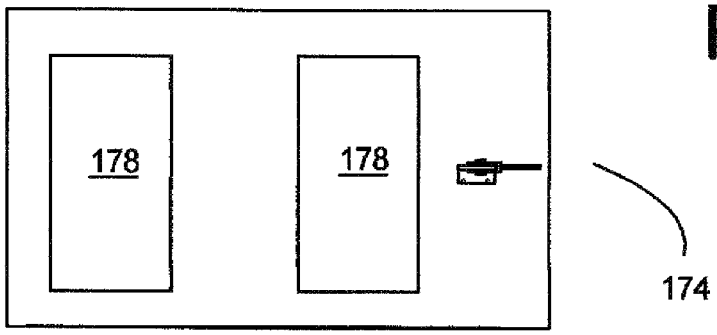
Figure 5C:
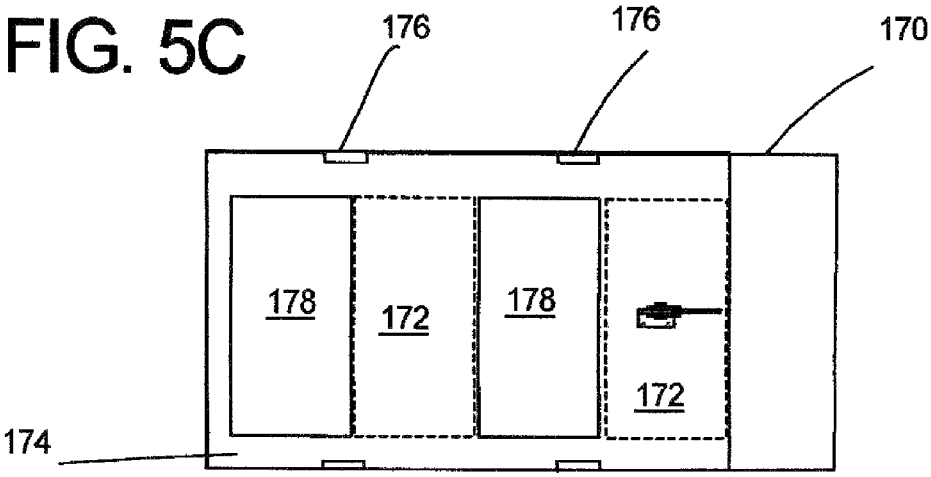

Another embodiment of the means 152 is shown in FIGS. 5A, 5B, and 5C. As seen in FIG. 5A, a bottom air flow window 170, being made of sheet plastic, for example, is fixedly mounted in the bottom of the air intake 110. Two portal windows 172 are cut out. On top of that a movable air flow window 174 is attached with brackets 176. Also two congruent portal windows 178 are cut out. FIG. 5C shows the movable air flow window 174 mounted on top of the bottom air flow window 170 and having the windows adjacent and not in communication. When the movable air flow window 174 is moved to the right by opening the door 120, the adjacent windows will move to coincide to allow air to pass. As shown in FIG. 3, a screen 180 can be placed over the air intake 110 to prevent bugs from entering into the box-like frame 102.

Figure 6A:
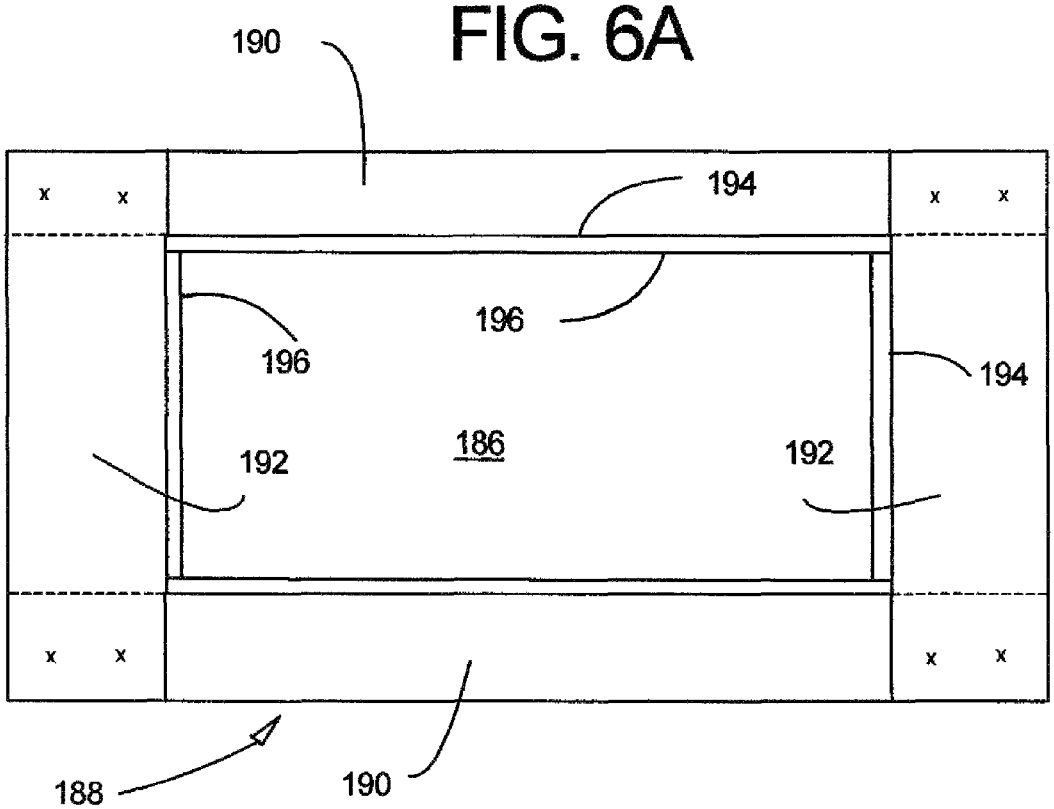
FIGS. 6A and 6B illustrate by a top view and a side view a frame to provide for different sizes of filters in the window fan of the present invention.
Figure 6B:
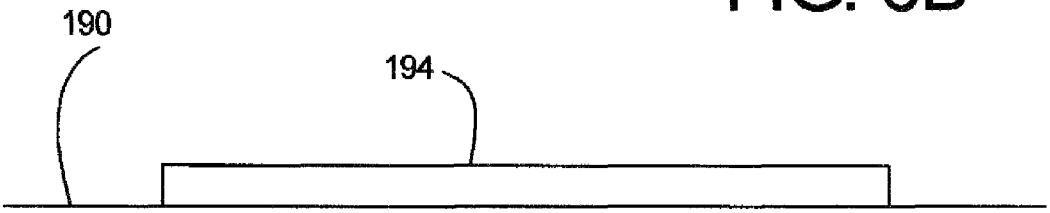

It is understood that a smaller filter 186, FIGS. 6A and 6B, may be used in the present invention and thus a the smaller filter 186 is shown mounted in the reduced size filter frame 188 and this can then be inserted into the opening for the maximum sized filter having the rails thereon. The frame 188 may be made of either plastic or sheet metal and has two sides 190 and two ends 192. These can be tack welded at points "x". In order to hold the filter, each side or end has a wall 194 forming a box like opening with a lip 196 that would support the filter.

The fan 100 further includes a pair of side wings 198, only one shown in FIG. 1A, for mounting to the sides 200 of the box-like frame 102 to block an opening between the box-like frame 102 and the window frame when mounted therein. The side wing 198 may be made of a sheet of heavy plastic 202 attached to a mounting bracket 204 that can be screwed on to the sides 200. The outer end 206 of the plastic wing 198 may be cut to fit behind a stop of the window frame with the top edge 208 resting against the bottom window stile.

Figure 7A:
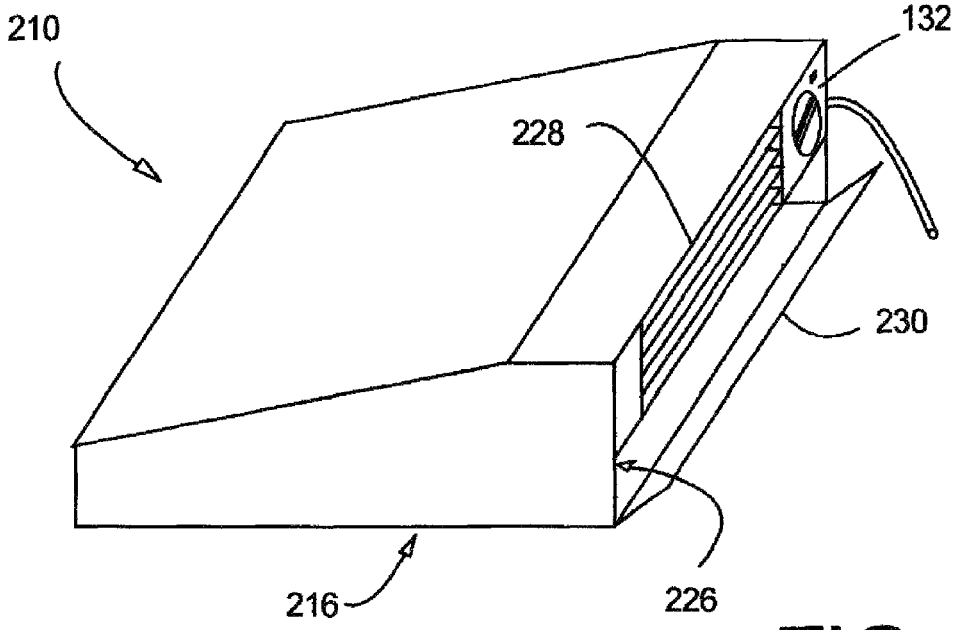
FIGS. 7A and 7B illustrate by a perspective view and a bottom view another embodiment of the invention for only purifying outside air.
Figure 7B:
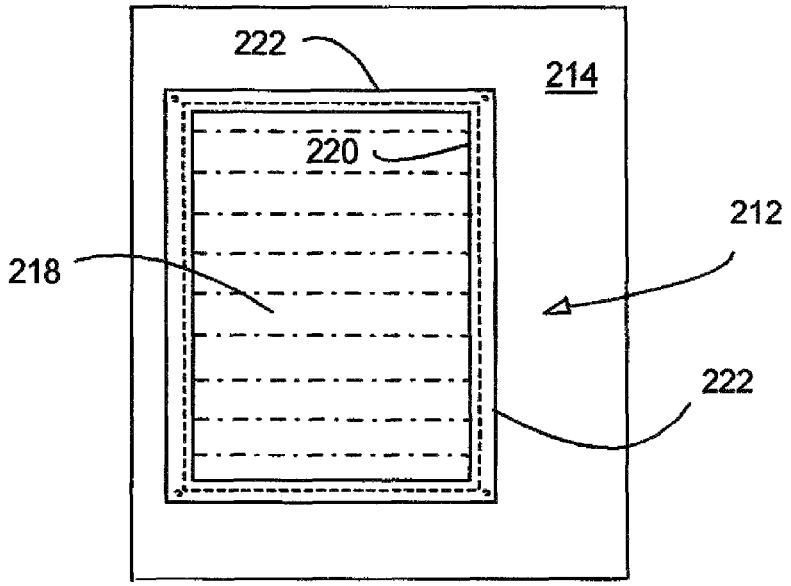

An another embodiment of the low profile, high volume, filtered fan 210 is shown in FIGS. 7A and 7B. This fan 210 provides only purification of outside air and has many similar features as the fan 100 above, but the differences go to providing only purified outside air. An outside air intake 212 is mounted in a bottom section 214 of said box-like frame 216 and positioned on an outside of the window when mounted therein. A filter 218 is mounted in the air intake 212 by means of a surrounding frame 220 being "T" shaped with the filter 218 resting upon one lip 222 of the "T". The other lip 224 is attached to the bottom section 214 by screws, for example. When mounted therein, air flows through the outside air intake 212 and through the filter 218 and into a single plenum 226. A blower fan 122 is mounted near a front section 228 of the box-like frame 216 and is operatively connected to the single plenum 226 therein. A similar control section 132 may be used.

The box-like frame 216 may include a filter door 230 in the front section 228 so that when the door 230 is opened the filter can be inserted over said outside air intake. This would prevent the need of removing the fan 210 or climbing or reaching up to the filter-surrounding frame 220 to remove it. The box-like frame 216 may be approximately 20 inches wide, approximately 30 inches deep and 6 to 8 inches high in the front section, a back section being about 6 inches high.

Since many modifications, variations, and changes in detail can be made to the described embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A low profile, high volume, filtered window fan, said window fan comprising:

a box-like frame, said box-like frame being adapted to mount in a lower section of a window in a low profile configuration, being secured in the window by an upper window stop resting against a horizontal sash of the window, and a lower window stop resting against a sill of the window;

an outside air intake, said outside air intake being in a bottom section of said box-like frame and positioned on an outside of the window;

means for controlling the air flow through said outside air intake;

an inside air intake, said inside air intake being mounted in a front section of said box-like frame and located inside of the window when the fan is mounted therein, said inside air intake having a door thereon;

a blower fan, said blower fan being mounted near a front section of said box-like frame;

a control section mounted in the upper section, said control section having a speed control function and an on-off function therein for supplying power to said blower fan from an external power source;

a means for mounting a filter in said box-like frame;

an upper plenum and a lower plenum within said box-like frame, said upper plenum and said lower plenum separated by a filter when mounted therein, said upper plenum providing outside air to said blower fan from said outside air intake and passing through said filter to said upper plenum, said lower plenum providing inside air to said blower fan from said inside air intake and passing through said filter and said upper plenum; and a means for controlling an amount of outside air and inside air to said blower fan such that closing said door opens said means for controlling the air flow through said outside air intake and opening said door allows for recirculating said inside air.

2. The low profile, high volume, filtered window fan as defined in claim 1 wherein said box-like frame has a top cover that sloops downwardly from the window to allow water to drain away from the window.

3. The low profile, high volume, filtered window fan as defined in claim 1 wherein said box-like frame is approximately 20 inches wide, approximately 30 inches deep and 8 inches high in the front section, a back section being about 5 inches high, and a flat upper section being about 6 inches deep.

4. The low profile, high volume, filtered window fan as defined in claim 1, wherein said outside air intake includes a screen to prevent bugs from entering into said box-like frame.

5. The low profile, high volume, filtered window fan as defined in claim 1 wherein said means for controlling the air flow in said outside air intake comprises one or more louvers or one or more air control windows.

6. The low profile, high volume, filtered window fan as defined in claim 1 wherein said blower fan is a squirrel cage blower fan, said squirrel cage being mounted in a horizontal position.

7. The low profile, high volume, filtered window fan as defined in claim 1 wherein said means for mounting a filter in said box-like frame comprises a pair of rails mounted to said box-like frame, the filter being inserted through the open door of the front section, and slidably positioned on said rails wherein said filter divides the interior volume of said box-like frame into said upper plenum and said lower plenum, said filter being substantially horizontally mounted in said box-like frame.

8. The low profile, high volume, filtered window fan as defined in claim 1, further including a reduced size filter frame, wherein a filter being smaller is mounted in the reduced size filter frame and can then be inserted into the opening for a maximum sized filter.

9. The low profile, high volume, filtered window fan as defined in claim 1, wherein said means for controlling an amount of outside air and inside air to said blower fan comprises one or more control rods, one control rod being rotatably mounted to the door for inside air intake, one end of a second control rod being mounted to said means for controlling the flow of outside air and to said control rod connected to the door of the inside air intake.

10. The low profile, high volume, filtered window fan as defined in claim 1, further including a pair of side wings for mounting to the sides of the box-like frame to block an opening between the box-like frame and the window frame when mounted therein.

11. The low profile, high volume, filtered window fan as defined in claim 1, further including a safe guard over the opening from which the air from the blower enters into a room.

12. A low profile, high volume, filtered window fan, said window fan comprising:

a box-like frame, said box-like frame being adapted to mount in a lower section of a window in a low profile configuration, being secured in the window by an upper window stop resting against a horizontal sash of the window, and a lower window stop resting against a sill of the window;

an outside air intake, said outside air intake being in a bottom section of said box-like frame and positioned on an outside of the window, wherein said outside air intake further includes a screen to prevent bugs from entering into said box-like frame;

means for controlling the air flow through said outside air intake;

an inside air intake, said inside air intake being mounted in a front section of said box-like frame and located inside of the window when the fan is mounted therein, said inside air intake having a door thereon;

a blower fan, said blower fan being mounted near a front section of said box-like frame;

a control section mounted in the upper section, said control section having a speed control and an on-off switch function therein for supplying power to said blower fan from an external power source;

a means for mounting a filter in said box-like frame;

an upper plenum and a lower plenum within said box-like frame, said upper plenum and said lower plenum separated by a filter when mounted therein, said upper plenum providing outside air to said blower fan from said outside air intake and passing through said filter to said upper plenum, said lower plenum providing inside air to said blower fan from said inside air intake and passing through said filter and said upper plenum; and a means for controlling an amount of outside air and inside air to said blower fan such that a linkage connects said door to said means for controlling the air flow through said outside air intake, and movement of said door results in movement of said means for controlling the air flow through said outside air intake.

13. The low profile, high volume, filtered window fan as defined in claim 12, further including a safe guard over the opening from which the air from the blower enters into a room.

* * * * *